US006290324B1

(12) United States Patent
Jackson et al.

(10) Patent No.: US 6,290,324 B1
(45) **Date of Patent: *Sep. 18, 2001**

(54) WET WIPING SYSTEM FOR INKJET PRINTHEADS

(75) Inventors: Kedrich J. Jackson, Camas; Thomas J. Purwins, Vancouver, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/918,273

(22) Filed: Aug. 25, 1997

Related U.S. Application Data

(63) Continuation of application No. 08/330,900, filed on Oct. 28, 1994, now Pat. No. 5,706,038.

(51) Int. Cl.[7] ..... B41J 2/165
(52) U.S. Cl. ..... 347/33
(58) Field of Search ..... 347/22, 23, 29, 347/30–33, 90

(56) References Cited

U.S. PATENT DOCUMENTS 4,859,527 * 8/1989 DiStefano ..... 442/327
5,489,927 * 2/1996 Harmon ..... 347/33
5,706,038 * 1/1998 Jackson et al. ..... 347/33

* cited by examiner

*Primary Examiner*—John Barlow
*Assistant Examiner*—Craig A. Hallacher
(74) *Attorney, Agent, or Firm*—Flory L. Martin

(57) ABSTRACT

A wet wiping system is provided that is particularly useful for wiping an inkjet printhead that uses pigment based ink. A wet wiping method has an admitting step, where ink is admitted though printhead nozzles, either by firing the inkjet cartridge with a low thermal turn on energy, or through capillary action provided by placing the printhead in contact with a wicking pad. In a dissolving step, any accumulated ink residue adjacent the nozzles is dissolved with the admitted ink. In a wiping step, the admitted ink and any dissolved ink residue is wiped from the printhead. One wet wiper has a cellulose acetate polyester blade supported on at least one side by a foam block. The wicking pad may have a ramped portion for gradually contacting the printhead, or a domed wicking surface that is compressed upon contact with the printhead to facilitate the capillary action.

20 Claims, 5 Drawing Sheets

WET WIPING SYSTEM FOR INKJET PRINTHEADS

The above-identified application is a continuation application of the parent application Ser. No. 08/330,900, filed on Oct. 28, 1994, issued on Jan. 6, 1998 as U.S. Pat. No. 5,706,038.

FIELD OF THE INVENTION

The present invention relates generally to inkjet printing mechanisms, and more particularly to a wet wiping system, including a method and an apparatus, for cleaning an inkjet printhead, such as may be used in inkjet printers, facsimile machines, plotters, scanners, and the like.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead moves back and forth across the page shooting drops as it moves. Typically, a service station is mounted within the printer chassis to clean and protect the printhead. During operation, clogs in the printhead are periodically cleared by firing a number of drops of ink through each of the nozzles in a process known as "spitting." The waste ink is collected in a reservoir portion of the service station, which is often referred to as a "spittoon."

For storage, or during non-printing periods, the service stations usually include a capping system which humidically seals the printhead nozzles from contaminants and drying. After spitting, uncapping, or occasionally during printing, most service stations have an elastomeric wiper that wipes the printhead surface to remove ink residue, as well as any paper dust or other debris that have collected on the printhead. The wiping action is usually achieved by either moving the printhead across the wiper, or moving the wiper across the printhead. One known wiper uses an elastomeric wiper blade that has a backing layer of a felt-like material, which probably assists in draining away excess ink from the wiper tip.

To improve the clarity and contrast of the printed image, recent research has focused on improving the ink itself. For example, to provide faster, more waterfast printing with darker blacks and more vivid colors, pigment based inks have been developed. These pigment based inks have a higher solid content than the earlier dye based inks. Both types of ink dry quickly, which allows inkjet printing mechanisms to use plain paper. However, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on, the print media, either of which degrades the print quality.

Another characteristic of these new pigment based inks contributes to the nozzle clogging problem. The pigment based inks use a dispersant to keep the pigment particles from flocculating. Unfortunately, the dispersant tends to form a tough film on the printhead face as the ink vehicle evaporates. Besides the debris accumulated on the printhead face from ink over spray, paper crashes and servicing, this dispersant film also attracts paper dust and other contaminants. This film, as well as ink residue and debris surrounding the printhead nozzles, is quite difficult to remove from the printhead.

With the earlier dye based inks, wiper blades were typically used to clean the printhead face, such as wipers made of an elastomeric material, for instance a nitrile rubber, ethylene polypropylene diene monomer (EPDM) elastomer, or other types of rubber-like materials. Unfortunately, the tough film formed by the pigment dispersant was not easily removable by these elastomeric wipers. Instead, this residue tended to ball up and roll, in a manner similar to the way that the adhesive known as rubber cement balls up when dried.

Several wet wiping systems have been proposed that wet the printhead then wipe it while still wet. One type of system spits ink then immediately wipes the ink from the printhead. Another system spits ink on the wiper then wipes the printhead with the wet wiper. Both of these ink-wiping systems used an EPDM elastomeric wiper. Another type of system applies a solvent to the printhead. In this system, the solvent is supplied through a saturated applicator to the printhead using a capillary or wicking action. The solvent is then wiped from the printhead using an EPDM elastomeric wiper. This solvent based wiping system unfortunately adds complexity and cost to the overall product.

Thus, a need exists for an improved system for cleaning inkjet printheads, which is directed toward overcoming, and not susceptible to, the above limitations and disadvantages.

SUMMARY OF THE INVENTION

According to one aspect of the present invention, a method is provided of wiping an inkjet printhead in an inkjet printing mechanism. The method includes the step of admitting ink through a nozzle of the inkjet printhead. In a dissolving step, any accumulated ink residue adjacent the nozzle is dissolved with the admitted ink. In a wiping step, the admitted ink and any dissolved residue is wiped from the printhead.

In one illustrated embodiment, the method further includes the step of placing the printhead in contact with a wicking pad. The admitting step comprises the step of extracting ink from the printhead through capillary action induced by the wicking pad. In another illustrated embodiment, the admitting step comprises ejecting ink by firing the printhead with a low thermal turn-on energy level that is lower than a normal thermal turn-on energy level used for printing. Firing at this low thermal turn-on energy level allows ink droplets to accumulate around the nozzle to act as a solvent used in the dissolving step.

According to another aspect of the present invention, a wet wiping system is provided for wiping an inkjet printhead used in an inkjet printing mechanism. The system includes a service station mounted to a chassis of the printing mechanism. The system also includes a wiper supported by the service station to selectively contact and wipe the printhead. The wiper comprises a wiping member of a plastic material and a resilient support member mounted to the service station adjacent the wiping member. In an alternate embodiment, a wet wiping system includes a service station mounted to a chassis of the printing mechanism and a wicking pad of an absorbent material supported by the service station to selectively contact the printhead and extract ink from the printhead through capillary action.

According to yet another aspect of the present invention, an inkjet printing mechanism is provided with one of these wet wiping systems.

An overall object of the present invention is to provide an inkjet printhead wet wiping apparatus and method for maintaining a high quality of printing with pigment based inks.

Another object of the present invention is to provide an effective wet wiping system which is low in cost and easy to manufacture, so as to provide an economical, compact and high quality inkjet printing mechanism.

DETAILED DESCRIPTION OF A PREFERRED EMBODIMENT

Figure 1:
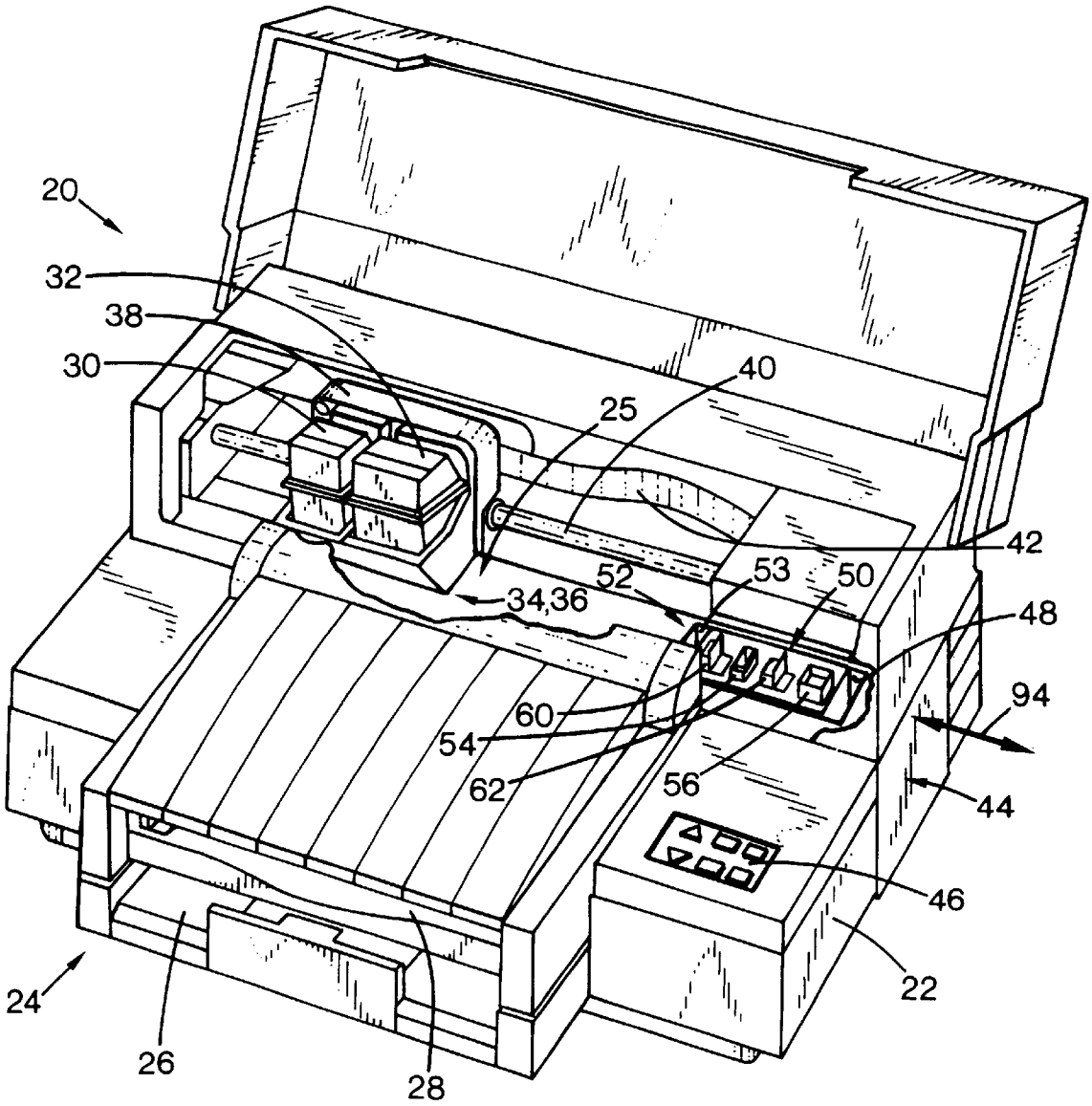
FIG. 1 is a perspective view of one form of an inkjet printing mechanism, here, an inkjet printer, showing a first embodiment of a wet wiping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of these printing mechanisms that may embody the present invention include plotters, portable printing units, copiers, cameras, and facsimile machines, to name a few, but for convenience the concepts of the present invention are illustrated in the environment of an inkjet printer 20.

While it is apparent that the printer components may vary from model to model, the typical inkjet printer 20 includes a chassis 22 and a print medium handling system 24 for supplying a print medium to the printer 20. The print medium may be any type of suitable sheet material, such as paper, card-stock, transparencies, mylar, foils, and the like, but for convenience, the illustrated embodiment is described using paper as the print medium. The print medium handling system 24 moves the print media into a print zone 25 from a feed tray 26 to an output tray 28, for instance using a series of conventional motor-driven rollers (not shown). In the print zone 25, the media sheets receive ink from an inkjet cartridge, such as a black ink cartridge 30 and/or a color ink cartridge 32. The illustrated color cartridge 32 is a tri-color pen, although in some embodiments, a group of discrete monochrome pens may be used, or a single monochrome black pen 30 may be used.

The illustrated cartridges or pens 30, 32 each include reservoirs for storing a supply of ink therein, although other ink supply storage arrangements, such as those having reservoirs mounted along the chassis may also be used. The cartridges 30, 32 have printheads 34, 36 respectively. Each printhead 34, 36 has a nozzle head comprising an orifice plate with a plurality of nozzles, such as nozzle 80 shown in FIGS. 3–4, formed therethrough in a manner well known to those skilled in the art. The illustrated printheads 34, 36 are thermal inkjet printheads, although other types of printheads may be used, such as piezoelectric printheads. The printheads 34, 36 typically include a plurality of resistors which are associated with the nozzles. Upon energizing a selected resistor, a bubble of ink is formed and then ejected from the nozzle and on to a sheet of paper in the print zone 25 under the nozzle.

The cartridges or pens 30, 32 are transported by a carriage 38 which may be driven along a guide rod 40 by a conventional drive belt/pulley and motor arrangement (not shown). The pens 30, 32 selectively deposit one or more ink droplets on a sheet of paper in accordance with instructions received via a conductor strip 42 from a printer controller, such as a microprocessor which may be located within chassis 22 at the area indicated generally by arrow 44. The controller typically receives instructions from a computer, such as a personal computer. The printhead carriage 38, as well as the carriage motor and paper handling system drive motor each operate in response to the printer controller, which operates in a manner well known to those skilled in the art. The printer controller may also operate in response to user inputs provided through a key pad 46. A monitor coupled to the computer may be used to display visual information to an operator, such as the printer status or a particular program being run on the computer. Personal computers, their input devices, such as a keyboard and/or a mouse device, and monitors are all well known to those skilled in the art.

The printer chassis 22 defines a chamber 48 that provides a printhead servicing region configured to receive a service station 50, located at one end of the travel path of carriage 38. The service station 50 includes a platform or frame 52 mounted within the servicing region to support various service station components, such as wipers, caps, priming units and spittoons. A variety of suitable spittoon, capping and priming designs are commercially available. The illustrated service station 50 includes a spittoon 53, shown located to the inboard side of platform 52, that is, toward the print zone 25. The spittoon 53 is used to collect ink which is ejected or "spit" from the printheads 34, 36 during operation. Spitting assists in clearing blockages or occulations from the nozzles of the printheads 34, 36. The service station 50 may also includes black and color caps 54, 56 for selectively sealing the black and color printheads 34, 36 when the pens are not in use. The caps 54, 56 help to prevent ink evaporation and clogging of the nozzles from dried ink during momentary breaks in printing, or when the unit is inactive for extended periods of time. In some embodiments, the caps 54, 56 may be connected to a pumping unit to assist in priming the printheads 34, 36 after extended periods of inactivity.

First Embodiment

Figure 2:
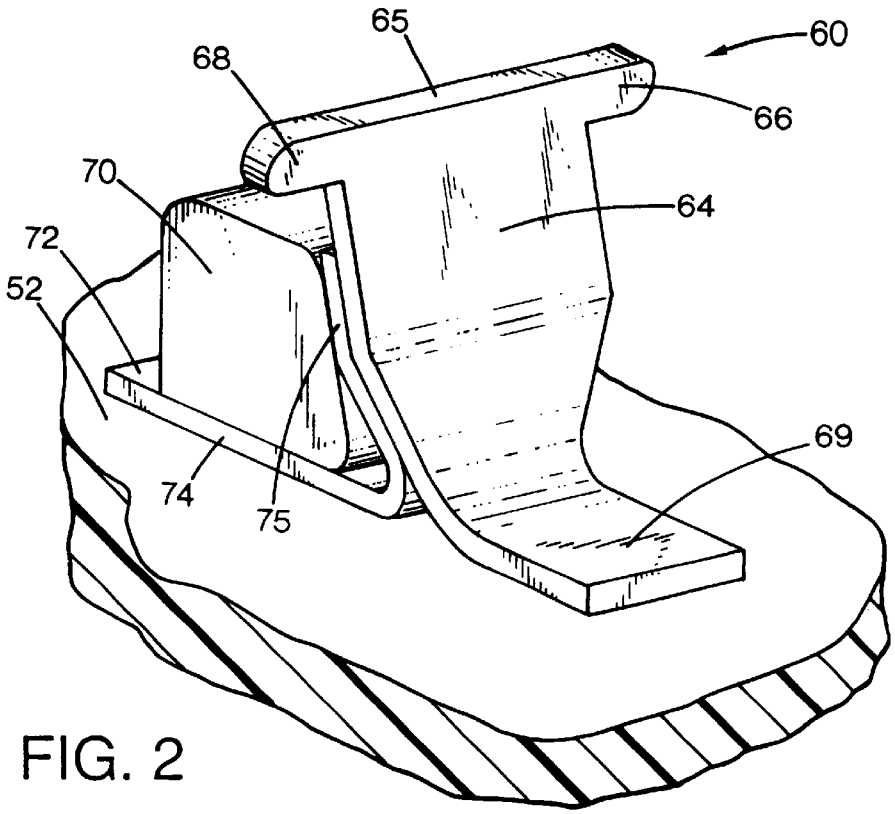
FIG. 2 is an enlarged perspective view of a second embodiment of a wet wiping device of the present invention.

The service station 50 also includes black and color wiper assemblies 60, 62, which selectively wipe the respective black and color printheads 34, 36. FIG. 2 illustrates the various components of the black wiper 60, which is particularly suitable for wiping pigment based inks. The color wiper 62 may be constructed as described for the black wiper 60. If dye based inks are used in the color pen 32, then a conventional blade style wiper of a rubber-like material, such as wiper 140 in FIGS. 7 and 8, may be used instead. The wiper assembly 60 includes a main wiper member or blade 64, which is preferably of a semi-rigid material, on the order of 0.10–0.13 millimeters (0.004–0.005 inches, or 4–5 mils) thick, or more preferably, of a cellulose acetate polyester material. The wiper blade 64 has a wiping edge 65 flanked by flange portions 66 and 68, which aid in cleaning ink spray from regions adjacent the nozzles of the printhead 34. In particular, the flange portions 66 and 68 wipe any printhead nozzles located adjacent ridges on the pen surface, such as elongated end beads on the pen face. The wiper blade 64 may include a mounting leg portion 69, used to adhere or otherwise bond the blade 64 to the service station platform 52, although it is apparent that other mounting schemes may be used, such as a clamping mechanism for instance, to support the wiping edge 65 in a substantially upright position for contacting the printhead 34.

In one preferred embodiment, the width of the wiper blade 64 between the opposing ends of the flange members 66, 68 is about 14.0 mm. The height of the wiping edge 65 from the platform 52 is approximately 17.0 mm. The length of each flange member 66, 68 is about 2.0 mm and the height of each flange member is about 0.76 mm (0.030 inches). The lower portion of the flange members 66, 68 is preferably located about 12.0 mm above platform 52. These wiper dimensions are particularly useful for wiping a printhead having 300 nozzles aligned in two linear arrays of about 12.7 mm (0.5 inches) in length, separated by a spacing of about 4.0 mm (0.16 inches). In the illustrated embodiment, the thickness of the wiper blade 64 may be between 0.10 and 0.25 mm, with approximately 0.19 mm (0.0075 inches) being a suitable thickness used during prototype testing.

The wiper assembly 60 also includes a resilient blocking or support member, which may be made of any type of resilient material, but preferably is of a reticulated or close cell foam, sponge, or the like, such as a foam block 70. Preferably, the foam block 70 is of a modified open cell polyurethane foam, such as that sold under the trademark Poron®, manufactured by the Rogers Corporation, of Rogers, Connecticut. The foam block 70 provides lateral support for the wiper blade 64 during wiping by biasing the blade 64 in an upright position relative to the path of travel of the printhead 30, so the edge 65 may provide a firm surface for wiping the printhead 34. In the illustrated embodiment, the height of the support block 70 is about 12.0 mm, and the depth and width are both about 10.0 mm. The wiper assembly 60 may also include an optional block mounting member or leaf 72 that may be used to mount the foam block 70 to the service station platform 52. The leaf 72 has a foot portion 74 and an upright portion 75, which aids in supporting the wiper blade 64 during wiping. Preferably, the block support leaf 72 is made of the same material as the blade 64.

Figure 3:
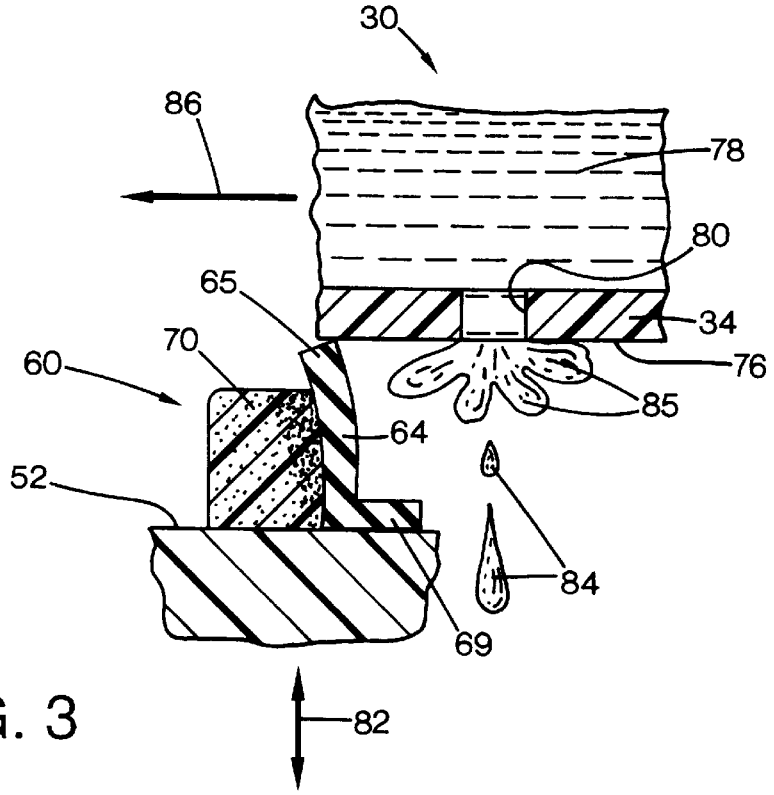
FIG. 3 is an enlarged side elevational sectional view of the wet wiping system of FIG. 1, shown wiping an inkjet printhead.

FIG. 3 illustrates one manner of wiping a face plate or pen face 76 of the printhead 34 using wiper assembly 60, constructed without the optional block support leaf 72. The printhead 30 is shown filled with ink 78, which is ejected through one or more orifices or nozzles, such as nozzle 80, of the printhead 34. The printhead ink ejection mechanism, which operates in response to controller 44, has been omitted for clarity. A variety of different ink ejection mechanisms may be used, such as piezoelectric mechanisms and thermal mechanisms. These various ink ejection mechanisms are commercially available in inkjet cartridges and well known to those skilled in the art.

According to a preferred method of operation, the service station platform 52 is moved upward as viewed in FIG. 3, as indicated by the double-headed arrow 82, until a wiping edge 65 lies substantially above a plane defined by the pen face 76. The mechanism for moving the service station platform 52 may be implemented in many different ways, a variety of which are commercially available in inkjet printing mechanisms, and well known to those skilled in the art. For example, service station platform moving mechanisms are shown in U.S. Pat. Nos. 4,853,717 and 5,155,497, both assigned to the present assignee, Hewlett-Packard Company.

In a lubricating step, preferably prior to wiping contact of the nozzle 80 with the wiping edge 65, the ink ejection mechanism is operated to expel ink from, or admit ink 78 to pass through, the nozzle 80. Preferably, the ink is ejected using a low thermal turn-on energy (TTOE) firing of the pen 30. A low thermal turn-on energy level refers to a 60–80% of the full or normal voltage level which is typically used to expel ink during printing. Rather than ejecting ink for printing, this low TTOE firing strategy produces primary ink droplets 84, and a group of secondary droplets 85 which adhere to the printhead face 76 adjacent the opening of nozzle 80. The secondary droplets 85 dissolve any hardened ink adjacent nozzle 80. The secondary droplets 85 also lubricate the pen face 76 and wiping edge 65 to assist in wiping when the pen 30 passes over wiper 60 in the normal direction shown by arrow 86. This lubrication feature allows pen wiping with less force than required for a dry wipe, so the service station components can be more optimally designed with less material required for structural strength. This optimal design advantage provides a lighter weight, compact and more economical product, such as the printer 20.

Second Embodiment

Figure 4:
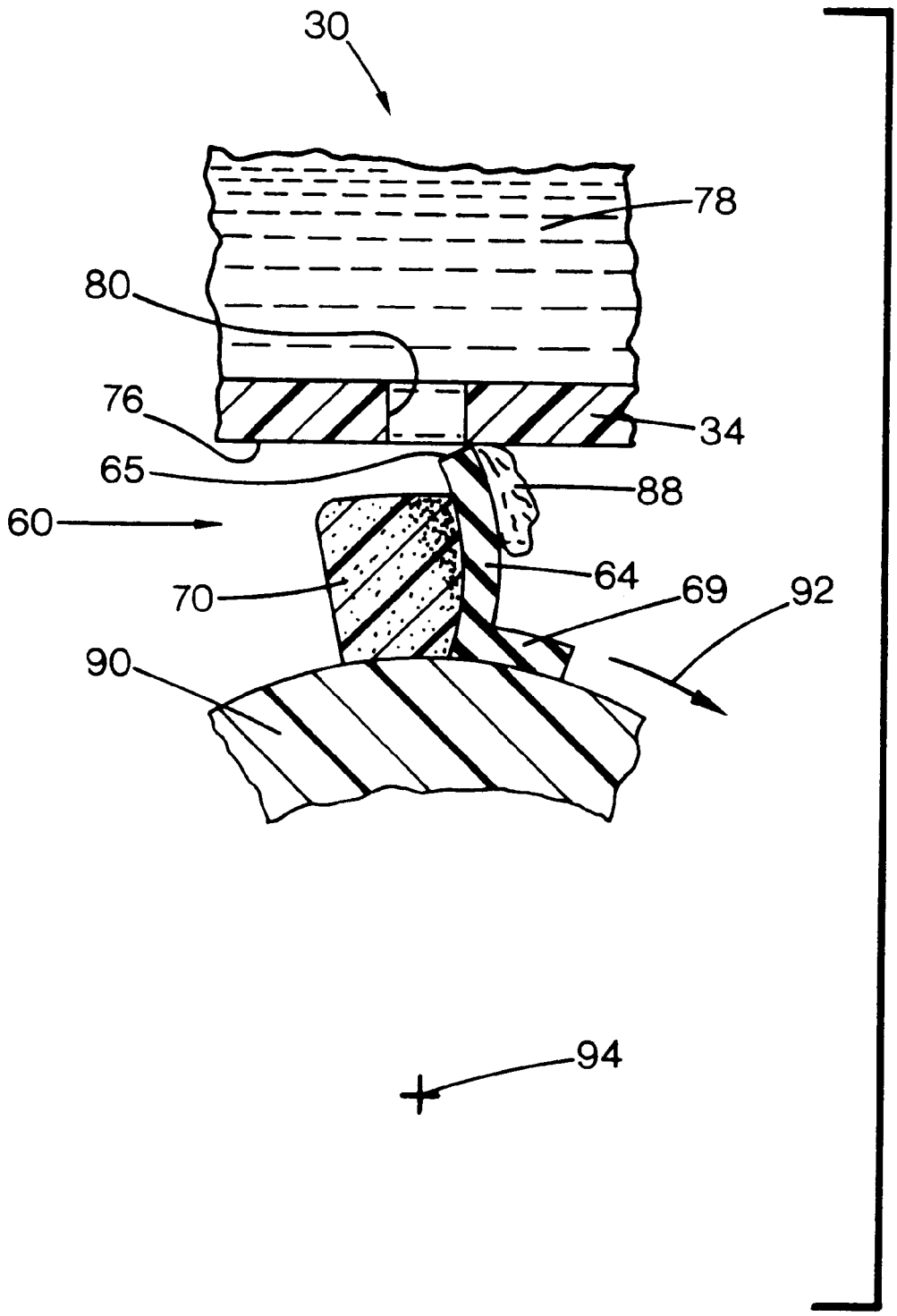
FIG. 4 is an enlarged side elevational sectional view of a third embodiment of a wet wiping system of the present invention, shown wiping an inkjet printhead.

FIG. 4 illustrates an alternate embodiment for mounting and using the wiper assembly 60. The wiper assembly 60 is shown wiping the ink residue 88 from the region of nozzle 80. In this embodiment, rather than using the relatively flat service station platform 52, which preferably moves translationally in a single plane, as illustrated by arrow 86 in FIG. 3, the embodiment of FIG. 4 uses a rotating platform 90. The platform 90 rotates in a wiping direction indicated by the curved arrow 92, for example, about a pivot axis 94, which may be substantially parallel with the printhead carriage guide rod 40 (see FIG. 1). The rotating platform 90 may be coupled to the carriage drive motor or other motor by a gear assembly, or other drive linkage mechanism, known to those skilled in the art.

Thus, to accomplish wiping it is merely a relative movement between the printhead 34 and the wiper assembly 60 which is required. Use of the rotating platform 90 allows the wiper member 60 to move past the printhead 34, with the printhead held in a stationary position. In contrast, the wiper assembly 60 of FIG. 3 is held stationary and the cartridge 30 is in motion during wiping. Nonetheless, both FIGS. 3 and 4 illustrate the compression of the foam block member 70 during wiping, as well as the resiliency of the foam block 70 which keeps the wiper blade 64 in flexible contact with the printhead 34. This resilient flexibility of wiper assembly 60 provides for a clean wipe of the printhead 34, without damaging the pen face 76 or the nozzles 80.

Third Embodiment

Figure 5:
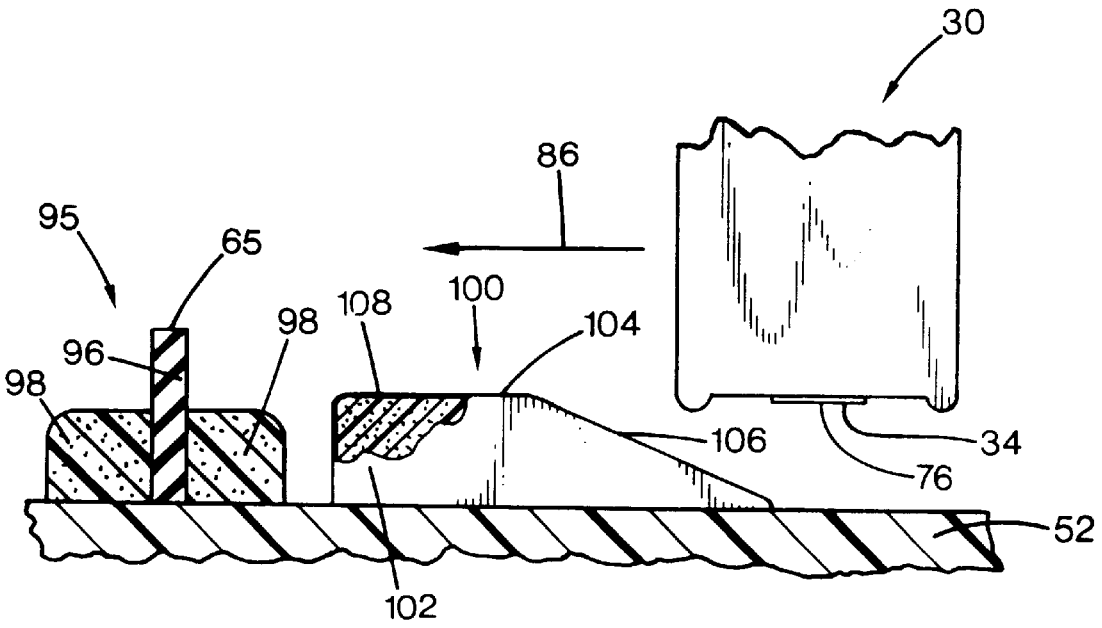
FIGS. 5 and 6 are enlarged, partially cut away, side elevational views of a fourth form of a wet wiping system of the present invention, showing different stages of operation.
Figure 6:
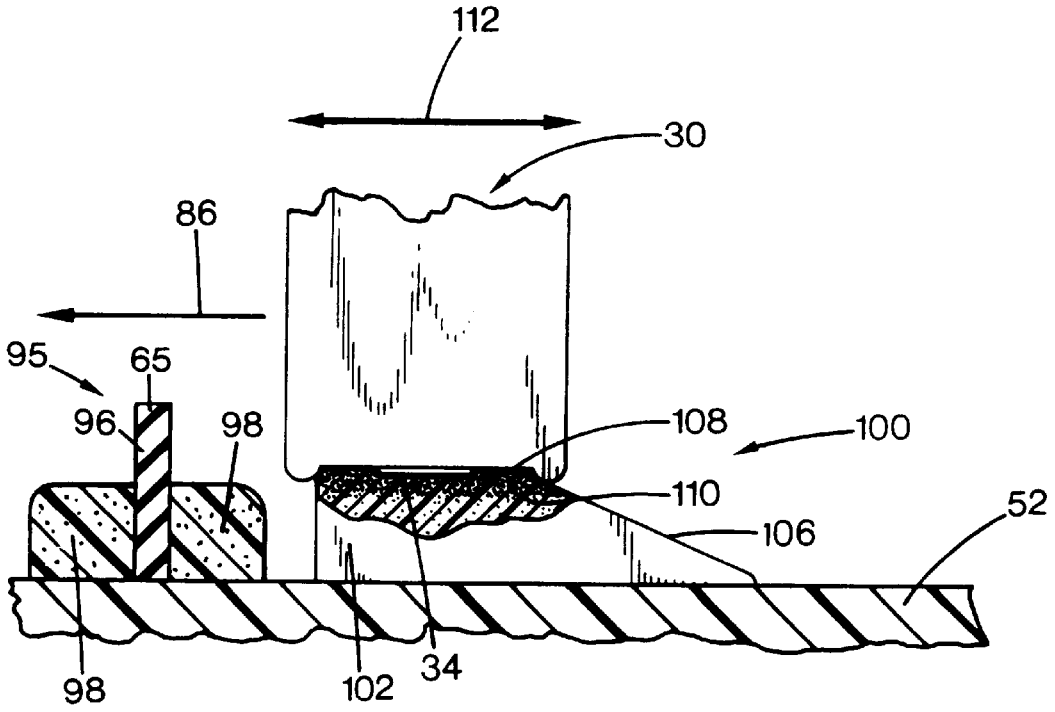

FIGS. 5 and 6 illustrate an alternate embodiment of a dual support wiper assembly 95, constructed in accordance with the present invention. The wiper assembly 95 has a main wiper member or blade 96 with a wiping edge 65, and preferably with a configuration as described above for the wiper blade 64, but without the leg portion 69. The wiper assembly 95 is flanked by two foam blocks 98, one on each side of the wiper blade 96. The wiper blade 96 and the foam support blocks 98 may be made of the same materials as described above for the components of wiper assembly 60. The wiper blade 96 and the foam support blocks 98 are supported by the service station platform 52, and affixed thereto by adhesive or other bonding techniques.

The wiper assembly 60 is particularly well suited for unidirectional wiping, with the foam block 70 positioned on the down stream of blade 64, relative to the wiping directions 86, 92 of printhead 30. In contrast, the wiper assembly 95 is suitable for bi-directional wiping, since the foam blocks 98 on each side of the wiper blade 96 provide support for wiping in either direction. The dual support provided by the pair of blocks 98 may be particularly useful with a back and forth scrubbing type of wiping action provided by a reciprocating motion of either the pen 30 or the wiper 95 relative to each other. When the motion of the printhead 34 relative to the wiper is either inboard toward the print zone 25, or outboard toward the service station 50, one of the blocks 98 provides the resilient, biasing support for blade 96 to maintain the wiping edge 65 in wiping contact with the pen face 76.

Fourth Embodiment

FIGS. 5 and 6 also illustrate an alternate manner of lubricating the printhead 34 prior to wiping, using a capillary wetting or wicking pad 100. The wicking pad 100 includes a body portion 102 of a compliant material, such as a foam, felt, cellulosic fiber, or other sponge-like material, and more preferably of a skinned poron foam, which applies a contact force against the printhead 34. Rather than firing the printhead 34 as in FIGS. 3 and 4, the ink for wet-wiping is expelled or admitted from the printhead through capillary action, as described farther below. Preferably the body 102 includes a ramped portion 106 which leads to a wicking platform 108. The ramp 106 aids in gradually bringing the wicking pad 100 into contact with printhead 34, as the cartridge 30 moves in the scanning direction indicated by arrow 86. Preferably, the wicking pad 100 is skinned or covered with a surface of capillary action inducing material, such as the matte surface of a mylar film, 3-M Brand Scotch® clear adhesive tape, or other structurally equivalent high surface energy materials, either of which may be bonded to the body portion 102 using various adhesives known to those skilled in the art. In another preferred embodiment, when the body 102 is of a poron foam material, the poron may be formed with a smooth cover layer or skin. This cover layer provides the capillary draw to wick ink from the printhead 34 when the printhead is in contact with the wicking pad 100.

From an initial position shown in FIG. 5, the pen 30 moves over the ramped portion 106. The ramp portion 106 aids in at least a partial preliminary removal of any dried ink debris, residue or other contaminants from the printhead 34 as the cartridge 30 moves into the wicking position. In the wicking position, shown in FIG. 6, the pen 30 has stopped with the printhead 34 in contact with the wicking platform 108. In the wicking position, the compliant material of the body 102 may be slightly compressed by the printhead 34 to facilitate the wicking action by narrowing the capillary passageways within pad 100. Adjacent the platform 108, the body 102 collects the extracted ink to form a wet-wipe ink reservoir region 110. In the wicking position, the ink admitted through the printhead 34 then works as a solvent on any remaining dried ink and debris that have collected on the printhead surface during printing. To assist in the capillary ink extraction, and to provide a preliminary wipe to the printhead surface 34, optionally the cartridge 30 may be agitated by small reciprocal movements back and forth across the wicking platform 108, as indicated by the double-headed arrow 112.

Optionally, the printhead 34 may be fired to eject droplets of ink to assist in lubricating the printhead 34 and/or initiating the capillary action by prewetting the pad 100. This prewet firing may be conducted as described above with respect to the embodiment of FIGS. 3 and 4, which used a low thermal turn-or energy (TTOE) firing scheme. After resting against the wicking platform 108 for a period of time, on the order of one to five seconds, the pen 30 then continues in the direction indicated by arrow 86. Before returning to printing, the pen 30 may be wiped by the wiper assembly 95, illustrated in FIGS. 5 and 6, or by the wiper assembly 60, with the foam support block 70 located to the left of the wiper edge 65 in FIGS. 5 and 6.

Fifth Embodiment

Figure 7:
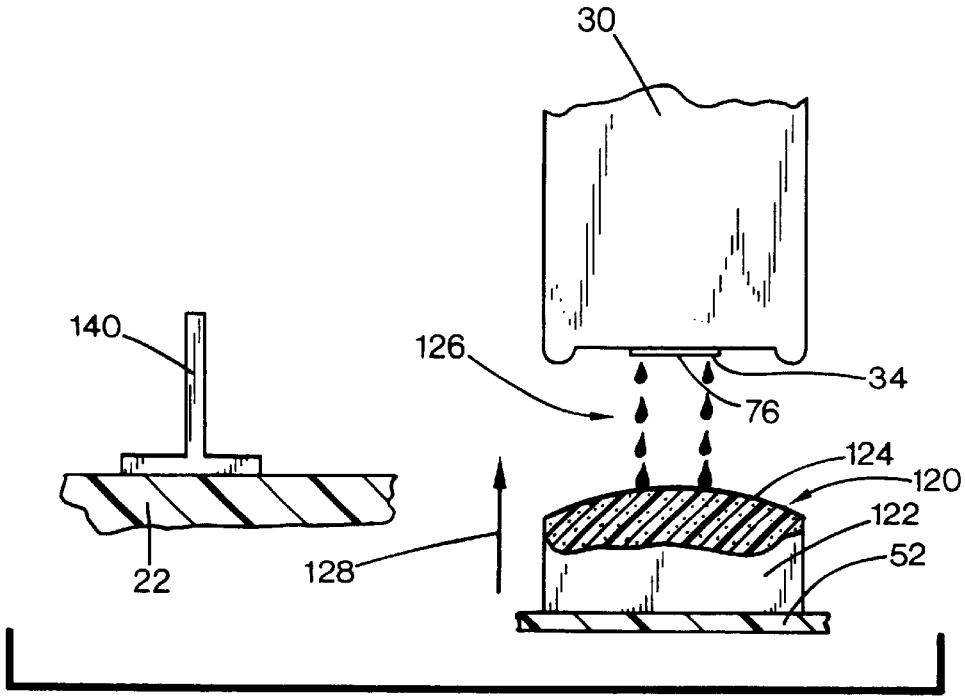
FIGS. 7 and 8 are enlarged, partially cut away, side elevational views of a fourth form of a wet wiping system of the present invention, showing different stages of operation.
Figure 8:
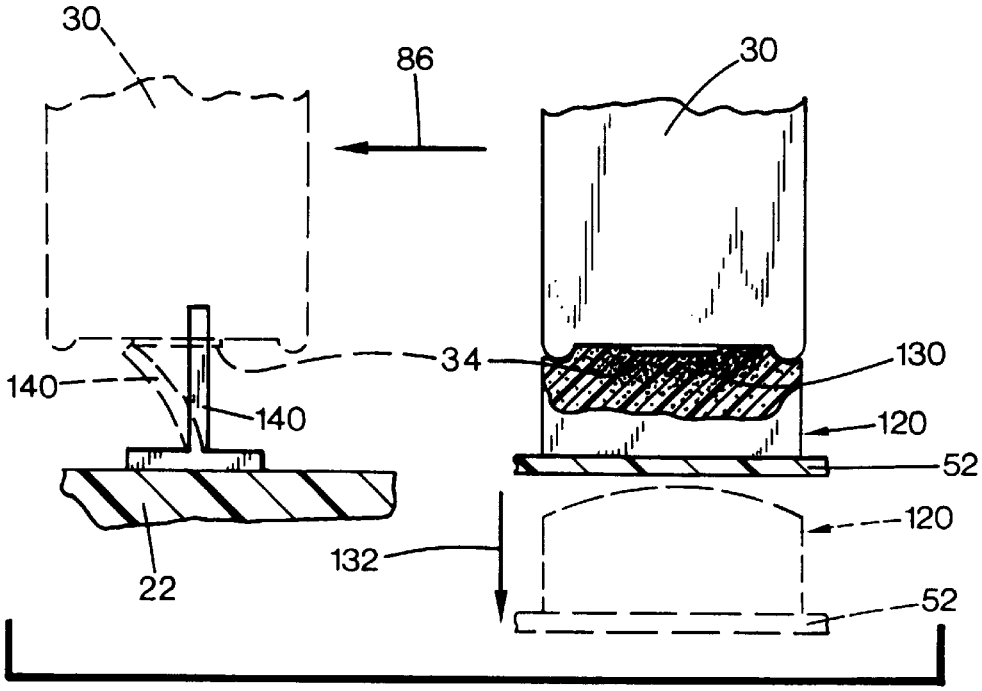

FIGS. 7 and 8 illustrate a fifth embodiment of a printhead wet wiping system constructed in accordance with the present invention which includes an alternate embodiment of a capillary wicking pad 120. Preferably, the wicking pad 120 has a body 122 with a slightly domed wicking platform 124. The wicking pad 120 is mounted to the service station platform 52, and may be constructed of the same materials as described above for the wicking pad 100 of FIGS. 5 and 6. As shown in FIG. 7, optionally the cartridge 30 may be fired to eject ink droplets 126 onto the wicking platform 124, which serve to pre-wet the pen face 76 and platform 124. The prewetting provided by ink droplets 126 promotes the capillary action by helping to ensure that the ink meniscus within each printhead nozzle is contacted by the wicking pad 120.

FIG. 7 shows the service station platform 52 moving toward the printhead 34, as indicated by arrow 128, until the printhead 34 is in wicking contact with pad 120, as shown in FIG. 8. When in wicking contact, preferably the printhead 34 partially compresses the wicking pad 120 to form an reservoir region 130, shown holding ink extracted through capillary action provided by the pad material. As shown in FIG. 8, the domed surface 124 may be compressed by the printhead 34, which expedites the wicking process by narrowing the passageways of the porous material in region 130. Moreover, the domed surface 124 gradually contacts the nozzles, particularly when the nozzles are aligned in two linear arrays (note the two columns of ink droplets 126 being ejected from each linear nozzle array in FIG. 7). This gradual contact provided by the domed surface 124 minimizes the possibility of forcing air into the nozzles which induces pressure spikes that could de-prime the pen 30.

FIG. 8 also illustrates an optional final step of retracting the service station platform 52 and capillary pad 120 away from the pen 30, as indicated by arrow 132. A rest position of the capillary pad 120 is shown in dashed lines in FIG. 8. It is apparent that the printhead 30 may alternatively be moved directly off of pad 120, in a direction indicated by arrow 86, without first lowering the pad. However, to assist in preserving the integrity of the domed surface 124, as well as to protect the pen face 76, it is preferable to move the service station platform 52 away from the pen 30 before moving the pen.

After the printhead 34 has been wetted at the capillary pad 120 to redissolve any dried ink on the printhead surface, the cartridge 30 moves in the direction indicated by arrow 86 to be wiped by a wiper 140. In the illustrated embodiment, with pad 120 mounted to the movable service station platform 52, the wiper 140 is preferably stationarily mounted to a portion of the chassis 22. The wiper 140 may be any type of conventional wiper, such as a blade wiper of a resilient, non-abrasive, elastomeric material, such as nitrile rubber, ethylene polypropylene diene monomer (EPDM), or other comparable material known in the art; however EPDM is preferred. The cleaning action of wiper 140 against printhead 34 is shown in dashed lines in FIG. 8.

It is apparent to those skilled in the art that the wiper assemblies 60 and 95 may also be used in place of the conventional wiper 140 shown in FIGS. 7 and 8. Alternatively, the capillary wicking pad 100 shown in FIGS. 5 and 6 may be used with the conventional wiper 140 of FIGS. 7 and 8. Indeed, one advantage of using the capillary wicking pads 100 and 120 is that they may be used with conventional wipers, such as wiper 140.

Methods of Operation

In conjunction with description of the various wiper assemblies, firing routines, and wicking pads described above a variety of methods of wet wiping an inkjet printhead are also apparent. In an admitting step, ink is admitted through the printhead nozzles 80, either by firing the pen (FIGS. 3 and 4), or through capillary action (FIGS. 6 and 8). In a dissolving step, any accumulated ink residue adjacent the nozzle is dissolved with the admitted ink. In a wiping step, the admitted ink and any dissolved residue is wiped from the printhead (FIGS. 3, 4, 6 and 8).

In the various embodiments, other steps are also provided. For example, with respect to FIGS. 3 and 4, the admitting step includes firing the printhead 34 with a low thermal turn-on energy to allow secondary ink droplets to accumulate around the printhead to act as a solvent. The wiping step may be accomplished by a relative movement between the printhead 30 and the wiper assembly 60, which may be provided by moving the printhead as indicated by arrow 86 (FIG. 3) across the wiper, or by rotating the wiper assembly 60 in the direction indicated by arrow 92 (FIG. 4) across the printhead 34. Several embodiments for constructing the wiper are illustrated as wiper assemblies 60 and 95, in FIGS. 2–6.

FIGS. 6–8 illustrate alternate methods of wet wiping, with the admitting step including the step of extracting ink from the printhead through capillary action. This extracting step may or may not be supplemented by firing the printhead 34 to prewet the wicking pads 100, 120. This optional firing may occur either at full energy, or at the low thermal turn-on energy (TTOE) described with respect to FIGS. 3–4. Various manners of providing relative motion of the capillary pads 100, 120 with respect to the cartridge 30 are shown to bring the printhead 34 into contact with wicking platforms 108 or 124. In FIGS. 5 and 6, the ramp 106 aids in gradually bringing the wicking pad 100 into contact with the printhead 34.

In the embodiment of FIGS. 7 and 8, the wicking pad 120 is brought into contact with the printhead 34 by moving the service station platform 52 toward the printhead, as indicated by arrow 128. After the wicking step of FIG. 8, the pad 120 is optionally first moved away from the printhead 34, as indicated by arrow 132, followed by the printhead moving toward wiper 140, as indicated by arrow 86. In the embodiments of FIGS. 6 and 8, the printhead 30 is then moved in the direction indicated by arrow 86 to be wiped by the respective wiper assemblies 95, 140. In a further optional agitating step, the printhead 34 may be agitated to assist in residue removal by reciprocating the pen 30 across the wicking pad 100, 120, for example, in the directions indicated by double-headed arrow 112 shown in FIG. 6.

Summary

A variety of advantages are realized using the wet wiping systems described above. For example, one advantage to the illustrated schemes for wiping the pigmented inks is that no external lubricants are needed to redissolve ink residue on the printhead 34. Additionally, the wet wiping systems 60, 95, 100, and 120 may be constructed of low cost materials, each having a simple geometry which is easy to manufacture and assemble. Moreover, with the capillary wicking pads 100 and 120, a traditional wiper 140 made of an EPDM elastomer or similar material may be used, although use of a more rigid wiper, such as wiper assembly 60 or 95 with the foam support blocks 70, 98 is also suitable. Additionally, while the various embodiments have been described with respect to the black ink cartridge 30, which uses a pigmented ink, these embodiments may also be used with color pigmented inks, or dye based inks, carried by cartridge 32.

We claim:

1. A method of cleaning an inkjet printhead in an inkjet printing mechanism, comprising the steps of:

contacting the printhead with a wicking surface of a non-ink retaining, a high surface energy material;

extracting ink from a nozzle of the printhead through capillary action induced between the wicking surface and the printhead during the contacting step;

dissolving any accumulated ink residue adjacent the nozzle with the extracted ink; and after said contacting step, wiping the extracted ink and any dissolved residue from the printhead.

2. A method according to claim 1, further including a step of agitating the printhead by reciprocal back and forth relative movement of the printhead and wicking surface during the extracting step.

3. A method according to claim 1, further comprising the step of ejecting ink by firing the printhead before the extracting step.

4. A method according to claim 1, wherein the contacting step comprises the step of moving the wicking surface into contact with the printhead which is held in a fixed position.

5. A method according to claim 1, wherein the contacting step comprises the step of moving the printhead into contact with the wicking surface which is held in a fixed position.

6. A method according to claim 1, the wicking surface includes an inclined portion and a platform portion, and the contacting step comprises the step of prewiping the printhead by moving the printhead along the inclined portion of the wicking surface then resting the printhead in contact with the platform portion of the wicking surface during the extracting step.

7. A method according to claim 1, wherein the wiping step comprises wiping the printhead with a wiper of a plastic material braced with a resilient foam member.

8. A method according to claim 1 further including the step of ejecting ink by firing the printhead with a low thermal turn-on energy level that is lower than a normal thermal turn-on energy level used for printing, with the low thermal turn-on energy level allowing ink droplets to accumulate around the nozzle to act as a solvent.

9. A method according to claim 1, wherein the wiping step comprises using a wiper of a cellulose acetate polyester material braced with a foam block located on a downstream side of the wiper relative to the wiping direction.

10. A wet wiping system for wiping an inkjet printhead used in an inkjet printing mechanism, comprising:

a service station mounted to a chassis of the printing mechanism;

a wicking pad having a wicking surface of a non-ink retaining, a high surface energy material, with the pad supported by the service station to selectively contact the printhead with the wicking surface to extract ink therefrom through capillary action induced between the wicking surface and the printhead; and a wiper supported by the service station to selectively wipe the extracted ink from the printhead.

11. A wet wiping system according to claim 10 wherein the wicking pad is of a foam material which imparts a domed shape to the wicking surface that is compressed when contacted by the printhead.

12. A wet wiping system according to claim 10 wherein the wicking pad has a ramped portion inclining toward the pad wicking surface.

13. A wet wiping system according to claim 10 wherein the wiper comprises a wiping member of a plastic material and a resilient foam support member mounted to the service station adjacent the wiping member.

14. A wet wiping system according to claim 10 wherein the wicking pad has a body of a compliant material selected from the group consisting of a foam material, a felt material and a cellulosic fiber material.

15. An inkjet printing mechanism, comprising:

a chassis;

a carriage that transports an inkjet printhead across a print zone and a printhead servicing region; and a wicking pad having a wicking surface of a non-ink retaining, a high surface energy material, with the pad supported by the service station to selectively contact the printhead with the wicking surface to extract ink therefrom through capillary action induced between the wicking surface and the printhead; and a wiper supported by the service station to selectively wipe the extracted ink from the printhead.

16. An inkjet printing mechanism according to claim 15 wherein the wicking pad is of a compressible material which imparts a domed shape to the wicking surface that is compressed when contacted by the printhead, and has a domed wicking surface which is compressed when contacted by the printhead.

17. An inkjet printing mechanism according to claim 15 wherein the wicking pad has a ramped portion inclining toward the pad wicking surface.

18. An inkjet printing mechanism according to claim 15 wherein the wiper comprises a wiping member of a plastic material and at least one resilient support member mounted to the service station adjacent the wiping member.

19. An inkjet printing mechanism according to claim 15 wherein:

the wiping member is of a cellulose acetate polyester material; and the support member comprises a block of a foam material.

20. A wet wiping system according to claim 15 wherein the wicking pad has a body of a compliant material.

* * * * *